US007524566B2

(12) United States Patent
Bamberg et al.

(10) Patent No.: US 7,524,566 B2
(45) Date of Patent: Apr. 28, 2009

(54) COMPOSITE MATERIAL, METHOD FOR THE PRODUCTION OF A COMPOSITE MATERIAL AND THE UTILIZATION THEREOF

(75) Inventors: Joachim Bamberg, Munich (DE); Falko Heutling, Munich (DE); Josef Mayr, Munich (DE); Klaus-Dieter Tartsch, Munich (DE)

(73) Assignee: MTU Aero Engines GmbH, Munich (DE)

( * ) Notice: Subject to any disclaimer, the term of this patent is extended or adjusted under 35 U.S.C. 154(b) by 148 days.

(21) Appl. No.: 10/575,695

(22) PCT Filed: Sep. 30, 2004

(86) PCT No.: PCT/DE2004/002175

§ 371 (c)(1),
(2), (4) Date: Apr. 13, 2006

(87) PCT Pub. No.: WO2005/040444

PCT Pub. Date: May 6, 2005

(65) Prior Publication Data

US 2007/0141298 A1 Jun. 21, 2007

(30) Foreign Application Priority Data

Oct. 18, 2003 (DE) ..... 103 48 506

(51) Int. Cl.
*B32B 15/14* (2006.01)

(52) U.S. Cl. ..... 428/608; 428/66.1; 428/66.6

(58) Field of Classification Search ..... 428/66.6, 428/66.1, 608, 614
See application file for complete search history.

(56) References Cited

U.S. PATENT DOCUMENTS

| | | | | |
|---|---|---|---|---|
| 3,419,952 | A | 1/1969 | Carlson | |
| 4,697,324 | A | 10/1987 | Grant et al. | |
| 4,900,599 | A | 2/1990 | Doble | |
| 4,919,594 | A | 4/1990 | Wright et al. | |
| 5,337,940 | A * | 8/1994 | Woods et al. | 228/190 |
| 5,431,984 | A * | 7/1995 | Keck et al. | 428/175 |
| 6,261,699 | B1 * | 7/2001 | Ress et al. | 428/293.1 |
| 6,916,550 | B2 * | 7/2005 | Ress et al. | 428/600 |
| 2002/0031678 | A1 | 3/2002 | Ress, Jr. et al. | |

FOREIGN PATENT DOCUMENTS

| | | | |
|---|---|---|---|
| EP | 490629 | A2 * | 6/1992 |
| EP | 909826 | A1 * | 4/1999 |

* cited by examiner

*Primary Examiner*—Alexander Thomas
(74) *Attorney, Agent, or Firm*—W. F. Fasse; W. G. Fasse

(57) ABSTRACT

A composite material is formed of several assembled discs of matrix material, wherein each disc preferably has at least one groove therein, and at least one fiber (14) is inserted in each groove. A composite of matrix material and fibers (14) is present in an inner section (16), whereas exclusively the matrix material is present in an outer section (17). The inner section with the fibers (14) reaches to different radial extents toward the outer section (17), to achieve a strength-optimizing intermeshing of the inner section (16) with the outer section (17).

17 Claims, 3 Drawing Sheets

Figure 1:
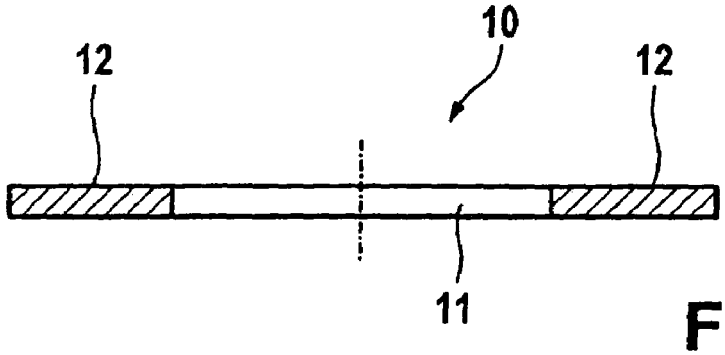

COMPOSITE MATERIAL, METHOD FOR THE PRODUCTION OF A COMPOSITE MATERIAL AND THE UTILIZATION THEREOF

FIELD OF THE INVENTION

The invention relates to a composite material, a method for producing composite material and to the use thereof.

BACKGROUND INFORMATION

Modern gas turbines particularly aircraft engines must satisfy the highest demands regarding reliability, weight, power output, efficiency and their life duration. During the last decades aircraft engines have been developed particularly in the civil sector, which engines fully satisfy the above demands. These aircraft engines have reached a high degree of technical perfection. In the design of aircraft engines the selection of the materials plays, among other things, a critical role. This applies also to the search for new suitable materials.

The most important materials that are used these days for aircraft engines or other gas turbines are titanium alloys, nickel alloys, also referred to as super alloys, and high strength steels. The high strength steels are used particularly for shaft components, gear components, and for compressor housings and turbine housings. Titanium alloys are typical alloys for compressor components while nickel alloys are suitable for the hot components of the aircraft engine.

A very promising group of a new material for future generations of aircraft engines are so-called fiber reinforced composite materials. Modern composite materials comprise a matrix material which may be made of a polymer, a metal, or ceramic matrix and fibers embedded into the matrix material.

The present invention relates to a composite material in which the matrix is made as a metal matrix. Such a material is referred to as a metal matrix composite material, in short MMC. In connection with high strength MMC materials in which titanium is used as matrix material, the weight of the structural components can be reduced up to 50% compared to conventional titanium alloys. Fibers of high strength and a high modulus of elasticity are used as reinforcements.

Such fiber reinforced composite materials are known in the prior art. Thus, European Patent Publication EP 0 490 629 B1 discloses a pre-shaped blank for a composite material including a foil whereby the foil comprises a groove and a thread shaped reinforcement arranged in the groove, and wherein the pre-shaped blank has the shape of a ring or of a disc. For the production of a multi-ply composite structure one proceeds according to European Patent Publication EP 0 490 629 B1 in such a way that several such pre-shaped blanks are stacked whereby the pre-shaped blanks are consolidated under the influence of heat and pressure to form a fully dense composite material. Further composite materials and methods for their production are known from European Patent Publication EP 0 909 826 B1, from U.S. Pat. No. 4,697,324 and from U.S. Pat. No. 4,900,599.

SUMMARY OF THE INVENTION

Starting with the above prior art the problem underlying the invention is to provide a new composite material and a new method for producing composite materials.

This problem is being solved by a composite material with the characteristics according to the present invention. The composite material comprises a matrix material and at least one fiber embedded in the matrix material. According to the invention a composite of matrix material and fibers is present within an inner section, whereas exclusively the matrix material is present in an outer section, and wherein the fibers reach to different extents into the outer section, in which exclusively the matrix material is present, for a strength optimizing intermeshing of the inner section with the outer section.

According to an advantageous further embodiment of the invention, the fibers neighboring an inwardly positioned opening terminate with an equal spacing from the opening, whereas next to the outer section in which the matrix material is exclusively present, the spacing is formed to vary.

The method according to the invention for producing a composite material serves for the production of a composite material of a matrix material and of at least one fiber embedded into the matrix material.

Preferably a recess (or groove) is formed in the disc whereby the groove has a depth larger than the diameter of the fiber in such a way that lands of the matrix material project above the fiber inserted into the groove.

According to an advantageous further development of the method according to the invention the fiber or each fiber is inserted into the groove or into each groove of the respective disc in such a way that a composite of matrix material and fiber is present in an inner section whereas in an outer section the matrix material is exclusively present. The discs are stacked in such a way that the fibers of the stacked discs reach to varying extents into an outer section in which the matrix material is exclusively present for a strength optimizing intermeshing between the inner section and the outer section.

Preferred further embodiments of the invention are defined by the dependent claims and the following description.

BRIEF DESCRIPTION OP THE DRAWINGS

Figure 2:
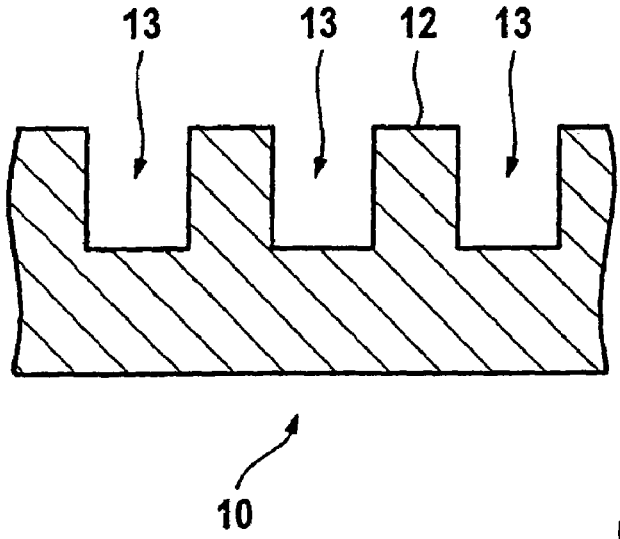
Figure 3:
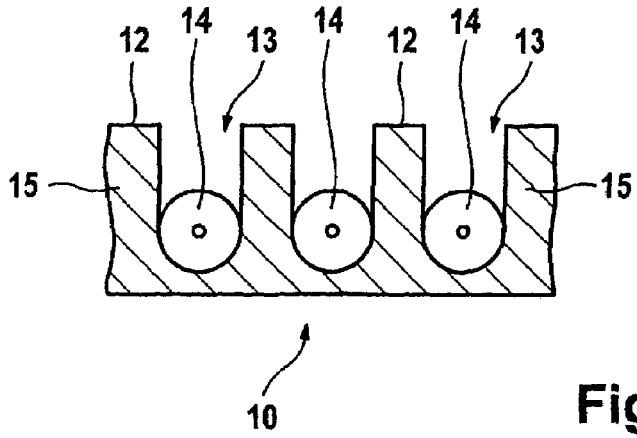
Figure 4:
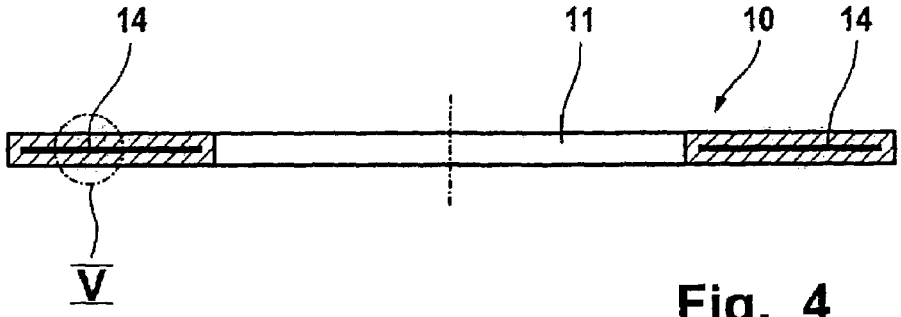
Figure 5:
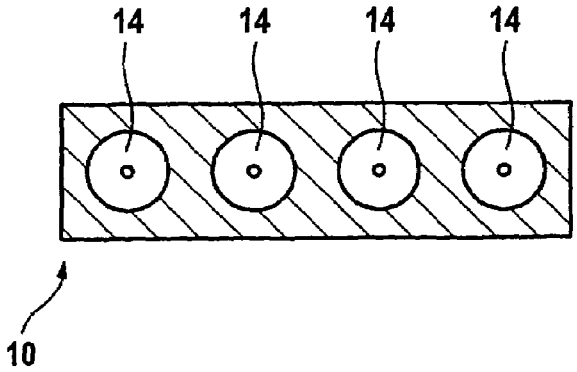
Figure 6:
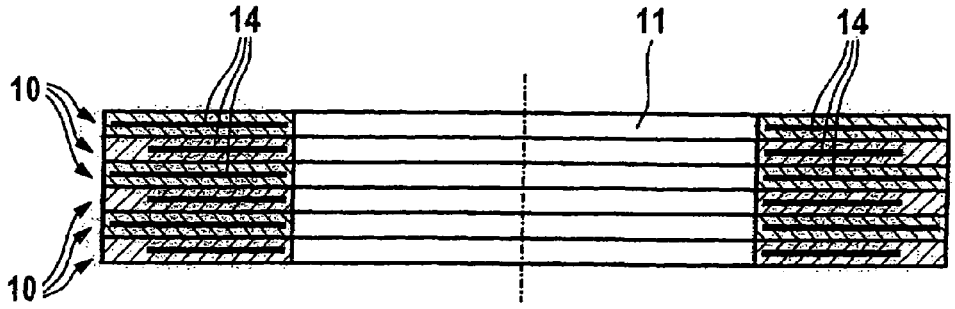
Figure 7:
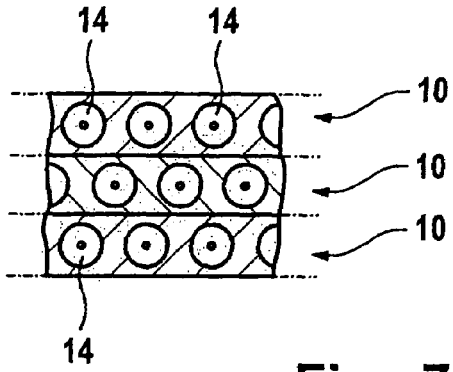

Example embodiments of the invention are described in more detail with reference to the drawing without being limited thereto. The drawings show:

FIG. 1 a schematic cross section of a disc of matrix material;

FIG. 2 a substantially magnified cutout of the disc of FIG. 1 with a recess (or groove) formed in the disc;

FIG. 3 the arrangement according to FIG. 1 with a fiber inserted into the groove;

FIG. 4 a schematic cross section of a disc of matrix material with an embedded fiber;

FIG. 5 the detail V of FIG. 4;

FIG. 6 a schematic cross section of a plurality of matrix material discs with embedded fibers stacked one on top of the other;

FIG. 7 a cutout of the arrangement of FIG. 6; and

Figure 8:
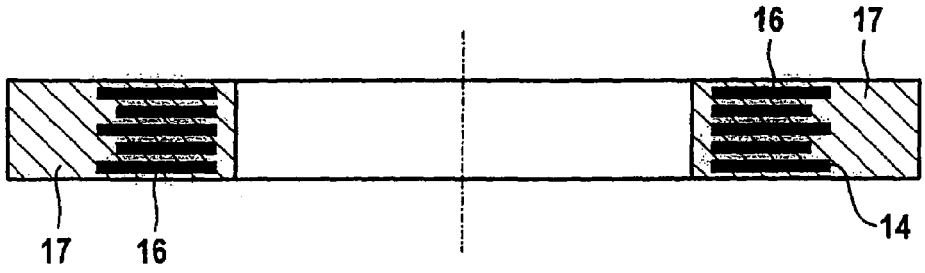

FIG. 8 a schematic cross section of a composite material according to the invention.

DETAILED DESCRIPTION OF EXAMPLE EMBODIMENTS OF THE INVENTION

Referring to FIGS. 1 to 8 details of the composite material according to the invention and details of the method according to the invention for producing the composite material will now be described in more detail.

The composite material according to the invention comprises a matrix material of titanium or of a titanium alloy as well as several fibers embedded in the matrix material. The fibers are preferably ceramic fibers made of silicon carbide (SiC). The composite material according to the invention is formed of several discs of matrix material whereby a fiber is embedded in each disc. A plurality of such discs with a fiber embedded therein are stacked one on top of the other and interconnected with each other to form the composite material according to the invention. A groove is formed in the respective disc of matrix material for the embedding of the fiber. The respective fiber is inserted into the groove and surrounded by matrix material on all sides so that the fiber is embedded in the disc.

FIG. 1 shows, in a substantially schematic cross section, a disc of matrix material, namely titanium. A bore 11 (or hole) is provided in a central section of the disc 10.

According to a first step of the method of the invention for producing the composite material according to the invention, a recess (or groove) is formed in a facing side 12 of the disc 10. FIG. 2 shows a substantially magnified detail of the disc 10 in the area of the facing side 12. The recess 13 which is formed in the facing side 12 of the disc 10 is a spiral groove. The spiral groove accordingly extends exclusively on a facing side 12 of the disc 10 from the inside of the disc 10 outwardly.

A fiber 14 is inserted into the spiral groove 13 after the formation of the spiral groove 13 in the top side 12 of the disc 10. It can be seen from FIG. 3, that lands 15 of matrix material project above the inserted fiber 14. Thus, the depth of the spiral groove 13 is larger than the diameter of the fiber 14.

Due to the groove 13 an exact guiding of the fiber 14 is assured. The position of the fiber 14 within the disc 10, namely within the matrix material, is thus exactly predetermined.

According to a further step of the method of the invention, the arrangement of FIG. 3 is subjected to a super-plastic deformation process. For this purpose the disc 10 or rather the matrix material is heated to a deformation temperature and subjected to a uniaxially directed pressure so that the lands 15 are deformed in a super-plastic manner in such a way that subsequently the fiber 14 is completely surrounded by the matrix material as shown in FIG. 5 so that the fiber 14 is embedded in the matrix material. FIG. 5 shows that the position of the fiber 14 is maintained even after the super-plastic deformation of the lands 15. The super-plastic deformation densifies the matrix material.

FIG. 4 shows a substantially schematic cross section of the disc 10 of matrix material with the fiber 14 embedded in the disc 10. The fiber 14 is surrounded on all sides by the matrix material and thus embedded in the matrix material.

Referring to FIG. 6, in the next step of the inventive method for producing the actual composite material, a plurality of discs 10 with fibers 14 embedded in the discs 10 are arranged one on top of the other so that in this manner a ring-shaped or cylinder-shaped stack is formed. The discs 10 arranged one above the other and stacked are then joined or interconnected with each other by diffusion welding under a small axial pressure. Thus, the composite material according to the invention is completed.

Prior to stacking the discs 10 as shown in FIG. 6 it is preferred to inspect (or check) the discs 10 with the fibers 14 embedded therein for cracks in the matrix material and for breaks in the fibers 14. This inspection can be performed by ultrasound, x-rays, or tomography. If a crack or a break is ascertained, the disc 10 is discarded. When the inspection shows that no crack and no break in the fiber 14 is present, the disc 10 can be used for the stacking.

FIG. 7 shows a cutout of the arrangement according to FIG. 6 in an area of three stacked discs 10 which are joined to each other. Thus FIG. 7 shows that the fiber 14 embedded in one disc 10 is staggered relative to the fibers 14 in the two neighboring discs 10. This staggering provides a hexagonal packing of the fibers 14. As shown in FIG. 7, the fiber 14 extends in a spiral in such a way within the disc 10 that in the cross section the resulting centers of the fibers of one disc 10 are arranged between the respective centers of the fiber 14 in a neighboring disc 10.

FIG. 6 shows that each fiber 14 in each disc 10 ends with a spacing from an outer, lateral end (or edge) of the respective disc. According to FIG. 6 this spacing varies or differs for each disc. On the other hand, next to the opening 11 positioned inwardly, the lateral spacing of the fibers 14 from the opening 11 is equal (for all fibers). With the aid of the varying or different lateral spacings between the fibers 14 and the outer lateral end (or edge) of the disc 10 it is possible to achieve gradual variations in the elastic characteristics of the composite material. Furthermore an intermeshing is achieved between the non-reinforced sections and the fiber reinforced sections of the composite material whereby the strength characteristics thereof are positively influenced.

FIG. 8 shows a substantially schematic cross section through a composite material according to the invention which was produced as described above. According to FIG. 8 fibers 14 are embedded in the matrix material in an inwardly positioned section 16 of the composite material. The matrix material however is exclusively present in an outwardly positioned section 17. This means that in the outwardly positioned section 17 only titanium is present. This feature has an advantage when the composite material must be further machined for example by milling, because the fibers 14 must not be damaged by the milling. A subsequent milling operation of the composite material is thus considered exclusively in the area of the section 17 in which the matrix material is exclusively present. Further, FIG. 8 shows again that next to the inwardly positioned opening the fibers 14 end with an equal spacing to the opening whereas at the outer end (or edge) next to the section 17, in which the matrix material is present exclusively, this spacing is formed to vary. The radial stepping of the fibers 14 in the section 16 relative to the section 17 has the effect of providing a strength optimizing intermeshing of the two sections 16 and 17.

Following the above described method according to the invention for producing the composite material according to the invention the procedure is roughly summarized as follows.

In a first step several discs of matrix material, namely titanium, are provided on their facing side with a spiral recess or groove. In a second step a fiber of silicon carbide is inserted into this spiral groove. Thereafter, in a third step the disc, with the fiber inserted into the disc, is consolidated by a super-plastic deformation. As a result, the fiber is surrounded on all sides by matrix material or embedded into the matrix material. In a next step the so produced discs with the fibers embedded in the discs are tested for cracks in the matrix material and for breaks in the fibers. If this testing shows that there is no crack nor any fiber break, the respective discs are stacked to form rings. The stack of a plurality of discs is then subjected, in a further step of the method according to the invention, to a diffusion welding so that neighboring discs are interconnected with each other. Upon completion of this joining step the composite material may in a further step be subjected to a finishing machining, for example by milling.

The method according to the invention is reliable and cost efficient. The method according to the invention can be performed in a fully automated process with an integrated testing thereby assuring quality. Since each disc is tested with regard to its quality, faults or defects in the composite material can be timely discovered and thus avoided. Such testing reduces rejects. A further advantage is seen in that the exact position of the fibers in the composite material is predetermined and maintained. The spiral arrangement of the fibers in the composite material is preferred. However other more complex fiber guiding is also possible, for example a star shaped fiber guiding. According to the invention a titanium coating of the fibers as is required in the prior art, is not necessary. A further advantage resides in that no extremely long fibers need to be used. Due to the guiding of the fibers in the grooves it is possible to use fibers of finite length.

The composite material according to the invention distinguishes itself, thus, by an exact position of the fibers within the matrix material. The composite material according to the invention is formed by a plurality of joined discs of matrix material whereby a spirally extending fiber is embedded in each disc. The fibers end with a spacing from a lateral outer end (edge) of the composite material so that in an outer section thereof the matrix material is exclusively present, whereby in this section a later milling operation can be performed on the composite material. For completeness sake it should be mentioned that several fibers may be embedded in one groove and that several grooves which are nested one within the other may be formed in one disc. Here again each of these grooves may hold one or several fibers. However, the shown example embodiment in which each disc has one groove for receiving one fiber, is preferred.

The composite material according to the invention is particularly suitable for use as a material for producing rings with integral blades for aircraft engines, which are also referred to as so-called bladed rings (blings).

The invention claimed is:

1. A semi-fabricated intermediate article for producing a composite material, comprising a plurality of discs (10) that each respectively comprise a matrix material and that are arranged as a loose stack of said discs which are not yet joined to one another, each said disc (10) in said stack further comprising: a radially inner opening (11) surrounded by an inner disc edge and a disc ring portion surrounding said inner opening and surrounded by an outer disc edge, said disc ring portion comprising a groove (13) and at least one reinforcing fiber (14) embedded in said groove (13) with said matrix material surrounding and consolidated around said at least one reinforcing fiber in said groove, thereby forming a fiber reinforced disc ring section, said reinforcing fiber (14) and said groove (13) being spaced radially outwardly from said inner disc edge thereby forming an inner first disc ring section free of reinforcing fiber, said reinforcing fiber (14) and said groove (13) being spaced radially inwardly from said outer disc edge thereby forming an outer second disc ring section free of reinforcing fiber, said fiber reinforced disc ring section being positioned between said first and second disc ring sections free of reinforcing fiber.

2. The semi-fabricated intermediate article for producing the composite material of claim 1, wherein said first disc ring section free of reinforcing fiber comprises a first radial width that is the same in each disc in said stack, and wherein said second disc ring section has a second radial width that differs in different discs in said stack.

3. The semi-fabricated intermediate article for producing the composite material of claim 2, wherein said second radial width that differs in different discs is individually adapted for each disc in said stack.

4. The semi-fabricated intermediate article for producing the composite material of claim 2, wherein said second disc ring section free of reinforcing fiber in one disc in said stack is overlapped by at least one fiber reinforced disc ring section of at least one neighboring disc in said stack at an interface between said fiber reinforced disc ring section and said second disc ring section free of reinforcing fiber.

5. The semi-fabricated intermediate article for producing the composite material of claim 1, wherein said groove in each disc in said stack has a spiral shape so that said at least one reinforcing fiber (14) extends spirally inside said fiber reinforced disc ring section.

6. The semi-fabricated intermediate article for producing the composite material of claim 1, wherein said matrix material comprises titanium or a titanium alloy, and said at least one reinforcing fiber comprises a silicon carbide fiber in each said disc in said stack.

7. The semi-fabricated intermediate article for producing the composite material of claim 1, wherein said grooves in neighboring discs of said stack are radially displaced relative to each other so that said at least one reinforcing fiber in a given disc is radially staggered relative to respective reinforcing fibers in neighboring discs in said stack.

8. A method of processing the semi-fabricated intermediate article for producing the composite material of claim 1, said method comprising the steps:

a) providing said plurality of said discs (10) of said matrix material, b) forming at least one said groove (13) in each disc of a number of discs in said plurality of discs (10), c) inserting said at least one reinforcing fiber (14) in each said groove (13) of a respective disc of said number of discs, d) consolidating each said disc with said at least one reinforcing fiber (14) in said groove (13) thereof respectively so as to form a consolidated disc in which said at least one reinforcing fiber (14) is surrounded on all sides and embedded in said matrix material, e) stacking said consolidated discs to form said loose stack as said semi-fabricated inter-mediate article, and f) joining each said disc in said stack to a neighboring said disc or discs in said stack to form a solid stack as said composite material.

9. The method of claim 8, further comprising performing said step of providing by producing said plurality of discs (10) with said radially inner opening (11) surrounded by said inner disc edge, forming said at least one groove in said fiber reinforced disc ring section with a first spacing from said inner disc edge, and forming said at least one groove in said fiber reinforced disc ring section with a second spacing from said outer disc edge of said disc (10) whereby said first disc ring section free of reinforcing fiber is formed radially inwardly of said groove (13) and said second disc ring section free of reinforcing fiber is formed radially outwardly of said groove, so that said fiber reinforced disc ring section with said at least one groove (13) therein is positioned between said first and second disc ring sections free of reinforcing fiber.

10. The method of claim 9, wherein said step of stacking is performed so that each said radially inner opening (11) of each said disc in said stack is axially aligned with all other said radially inner openings to thereby form a hollow cylinder.

11. The method of claim 8, further comprising performing said step of forming by making said groove (13) to a depth, in an axial direction, larger than a diameter of said at least one reinforcing fiber (14) so that lands (15) project above said at least one reinforcing fiber (14) inserted in said groove.

12. The method of claim 8, further comprising performing said step of consolidating each said disc (10) with said at least one reinforcing fiber (14) in said groove (13) thereof by exposing said disc to a superplastic deformation so that said fiber is enclosed on all sides by said matrix material.

13. The method of claim 8, wherein said step of joining is performed as a diffusion welding of said discs (10) to form said solid stack.

14. The method of claim 8, further comprising inspecting each said disc, following said consolidating step and before said stacking step, for any breaks in said at least one reinforcing fiber and for any cracks in said matrix material, and discarding any said disc in which a break or a crack is discovered.

15. A composite material article comprising a plurality of annular ring-shaped composite discs arranged axially aligned with one another and stacked successively to form a stack of said discs, wherein:

each respective disc of said plurality of composite discs respectively comprises an annular ring of a matrix material including an inner ring portion bounding a central axial hole of said disc, an outer ring portion bounded by an outer periphery of said disc, and an intermediate ring portion between said inner and outer ring portions;

each said respective disc respectively further comprises at least one reinforcing fiber that extends in a direction around said central hole in said intermediate ring portion, and said outer ring portion of said matrix material does not include said at least one reinforcing fiber therein; and each said respective disc is respectively bounded by first and second annular surfaces, and said at least one reinforcing fiber is embedded in and surrounded by said matrix material that is consolidated around said at least one reinforcing fiber, so that said at least one reinforcing fiber is located between and axially displaced inwardly away from said first and second annular surfaces, as results from a fabrication process in which a groove deeper than a diameter of said at least one reinforcing fiber was provided in said matrix material of said intermediate ring portion of said respective disc, said at least one reinforcing fiber was disposed in said groove of said respective disc, and said respective disc was consolidated so as to deform said matrix material thereof to close said groove around said at least one reinforcing fiber.

16. The composite material article according to claim 15, wherein said discs are loosely stacked on one another in said stack and are not yet joined to one another.

17. The composite material article according to claim 15, wherein said groove and said at least one reinforcing fiber extend along a spiral path around said central hole.

* * * * *